US008353266B2

(12) United States Patent
White et al.

(10) Patent No.: US 8,353,266 B2
(45) Date of Patent: Jan. 15, 2013

(54) ENGINE THROTTLE CONTROL WITH BRAKE BOOSTER

(75) Inventors: Stephen Michael White, Saline, MI (US); Mike Liebert, Saline, MI (US); Andrew Clement Dame, Saline, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/287,718

(22) Filed: Nov. 2, 2011

(65) Prior Publication Data

US 2012/0138005 A1 Jun. 7, 2012

(51) Int. Cl.
*F02N 11/08* (2006.01)
*F02D 41/06* (2006.01)
*F02M 1/00* (2006.01)

(52) U.S. Cl. ..... 123/179.3; 123/179.16

(58) Field of Classification Search ..... 123/179.3, 123/403, 179.16, 179.18; 701/113, 70; 303/114.3
See application file for complete search history.

(56) References Cited

U.S. PATENT DOCUMENTS

| | | | | |
|---|---|---|---|---|
| 2,264,126 | A | 11/1941 | Wydler | |
| 2,721,629 | A | 10/1955 | Saussard | |
| 4,211,200 | A | 7/1980 | Rocchio et al. | |
| 4,541,396 | A | 9/1985 | Sato et al. | |
| 5,005,550 | A | 4/1991 | Bugin, Jr. et al. | |
| 5,108,266 | A | 4/1992 | Hewitt | |
| 5,183,023 | A | 2/1993 | Hanson | |
| 5,676,101 | A | 10/1997 | Kawai et al. | |
| 6,017,100 | A * | 1/2000 | Mizuno et al. | 303/114.3 |
| 6,120,414 | A | 9/2000 | Endo et al. | |
| 6,334,834 | B1 | 1/2002 | Mizutani et al. | |
| 6,347,608 | B1 | 2/2002 | Hara et al. | |
| 6,557,524 | B2 * | 5/2003 | Tsunooka | 123/399 |
| 6,568,175 | B2 | 5/2003 | Izumiura et al. | |
| 6,735,942 | B2 | 5/2004 | Wild et al. | |
| 6,754,579 | B2 | 6/2004 | Kamiya et al. | |
| 6,773,374 | B2 | 8/2004 | Ogawa et al. | |
| 6,857,415 | B2 | 2/2005 | Kayama et al. | |
| 6,951,199 | B2 | 10/2005 | Suzuki | |

(Continued)

FOREIGN PATENT DOCUMENTS

EP 0990793 A3 5/2000

(Continued)

OTHER PUBLICATIONS

Pursifull, Ross Dykstra, "Method and System for Engine Air Control," U.S. Appl. No. 13/426,390, filed Mar. 21, 2012, 32 pages.

(Continued)

*Primary Examiner* — Stephen K Cronin
*Assistant Examiner* — Sizo Vilakazi
(74) *Attorney, Agent, or Firm* — Julia Voutyras; Alleman Hall McCoy Russell & Tuttle LLP

(57) ABSTRACT

Methods and systems are provided for reducing variability in air-fuel control due to variations in brake booster vacuum levels at an engine start. A throttle position is adjusted during an engine start based on the vacuum availability in the brake booster to control a rate of intake aircharge flow. By allowing aircharge to enter the intake manifold at a more consistent rate, air-fuel control is improved and exhaust emissions are reduced.

10 Claims, 4 Drawing Sheets

U.S. PATENT DOCUMENTS

| | | | | |
|---|---|---|---|---|
| 7,174,883 | B2 | 2/2007 | Sonoda et al. | |
| 7,216,479 | B2 | 5/2007 | Tamura | |
| 7,350,495 | B2 | 4/2008 | Harada | |
| 7,475,951 | B2 | 1/2009 | Ichikawa | |
| 7,610,140 | B2 | 10/2009 | Hirooka | |
| 7,650,221 | B2 | 1/2010 | Oi et al. | |
| 2002/0095932 | A1* | 7/2002 | Izumiura et al. | 60/285 |
| 2002/0116113 | A1* | 8/2002 | Kaneko | 701/112 |
| 2004/0182072 | A1* | 9/2004 | Majima et al. | 60/285 |
| 2004/0182363 | A1 | 9/2004 | Suzuki | |
| 2005/0000769 | A1 | 1/2005 | Hawener et al. | |
| 2005/0231034 | A1* | 10/2005 | Kerns et al. | 303/191 |
| 2007/0295303 | A1 | 12/2007 | Hirooka | |
| 2008/0121480 | A1 | 5/2008 | Kawamori et al. | |
| 2008/0264059 | A1 | 10/2008 | Hirooka | |
| 2008/0267789 | A1 | 10/2008 | Hirooka | |
| 2010/0036566 | A1 | 2/2010 | Hayami | |
| 2010/0282216 | A1* | 11/2010 | Hisaminato et al. | 123/48 R |
| 2011/0132311 | A1 | 6/2011 | Pursifull et al. | |
| 2011/0174266 | A1 | 7/2011 | Cunningham et al. | |
| 2011/0183812 | A1 | 7/2011 | Cunningham et al. | |

FOREIGN PATENT DOCUMENTS

| | | | |
|---|---|---|---|
| JP | 2005171925 | A | 6/2005 |
| WO | 2008084311 | A1 | 7/2008 |

OTHER PUBLICATIONS

Pursifull, Ross Dykstra et al., "Method and System for Brake Control," U.S. Appl. No. 13/290,873, filed Nov. 7, 2011, 27 pages.

Cunningham, Ralph Wayne et al., "Method and System for Controlling Engine Vacuum Production," U.S. Appl. No. 13/104,153, filed May 10, 2011, 33 pages.

Cunningham, Ralph Wayne et al., "Method and System for Providing Vacuum," U.S. Appl. No. 13/050,664, filed Mar. 17, 2011, 44 pages.

Pursifull, Ross Dykstra, "Method and System for Prioritizing Vehicle Vacuum," U.S. Appl. No. 13/050,700, filed Mar. 17, 2011, 40 pages.

Pursifull, Ross Dykstra et al., "Method and System for Providing Vacuum via Excess Boost," U.S. Appl. No. 13/050,683, filed Mar. 17, 2011, 46 pages.

Karnik, Amey Y. et al., "Engine Vacuum System," U.S. Appl. No. 13/050,647, filed Mar. 17, 2011, 32 pages.

Cunningham, Ralph Wayne et al., "Method and System for Controlling Vacuum," U.S. Appl. No. 12/899,370, filed Oct. 6, 2010, 30 pages.

Pursifull, Ross Dykstra et al., "Intake System Including Vacuum Aspirator," U.S. Appl. No. 12/721,445, filed Mar. 10, 2010, 45 pages.

Ulrey, Joseph Norman et al., "Method and System for Operating an Ejector," U.S. Appl. No. 13/050,632, filed Mar. 17, 2011, 35 pages.

Cunningham, Ralph Wayne et al., "A Method for Purging Fuel Vapors," U.S. Appl. No. 12/838,700, filed Jul. 19, 2010, 37 pages.

Vetrovec, John, "Fluid-Dynamic Supercharger", SAE Technical Paper Series 2008-01-0299; World Congress, Detroit Michigan, Apr. 14-17, 2008; 15 Pages.

Pursifull, Ross et al., "Discharging Stored EGR in Boosted Engine System," U.S. Appl. No. 12/684,322, filed Jan. 8, 2010, 41 Pages.

* cited by examiner

ENGINE THROTTLE CONTROL WITH BRAKE BOOSTER

BACKGROUND AND SUMMARY

Vehicle control systems may be configured to start an engine assuming a given intake manifold volume. However, interactions between vacuum levels in a brake booster and the intake manifold pressure at engine starts can cause variability in the air charge, and consequently air-to-fuel ratio at the engine starts. As such, this increases exhaust emissions.

One approach to address this variability is shown by Kayama et al. in U.S. Pat. No. 6,857,415. Therein, a valve is placed between the brake booster and the intake manifold to equalize the (remaining) pressure in the brake booster to atmospheric levels or to remove air from the intake manifold to the brake booster.

However, the inventors herein have identified a potential issue with such an approach. As one example, the valve used in the approach of Kayama et al. does not allow the level of intake manifold pressure (MAP) to be set from one engine start to another engine start. As another example, even with the valve, a consistent MAP level may not be attained at engine starts occurring at high altitudes as well as at sea level.

In one example, some of the above issues may be at least partly addressed by a method for starting an engine comprising positioning a throttle based on a vacuum reservoir pressure during a start. For example, in one embodiment, the throttle may be positioned based on an initial pressure in a brake booster during an engine start. By adjusting the position of the throttle at the engine restart, the rate at which air enters the engine may be controlled to be more consistent. Additionally, since manifold pressure at initial engine fueling affects both cylinder air charge and fuel vaporization, both consistency and accurate control can be used to improve air-fuel control. In this way, better air-to-fuel ratio control can be achieved during an engine start, thereby reducing emissions and improving the quality of the environment.

Note that in one example, the throttle positioning can include first fully closing the throttle, and then opening it to a position that is based on the reservoir pressure level identified before the engine start (e.g., before engine cranking while the engine was at rest). Alternatively, or additionally, the pressure level may be monitored during the cranking and run-up to identify the setting of the throttle.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
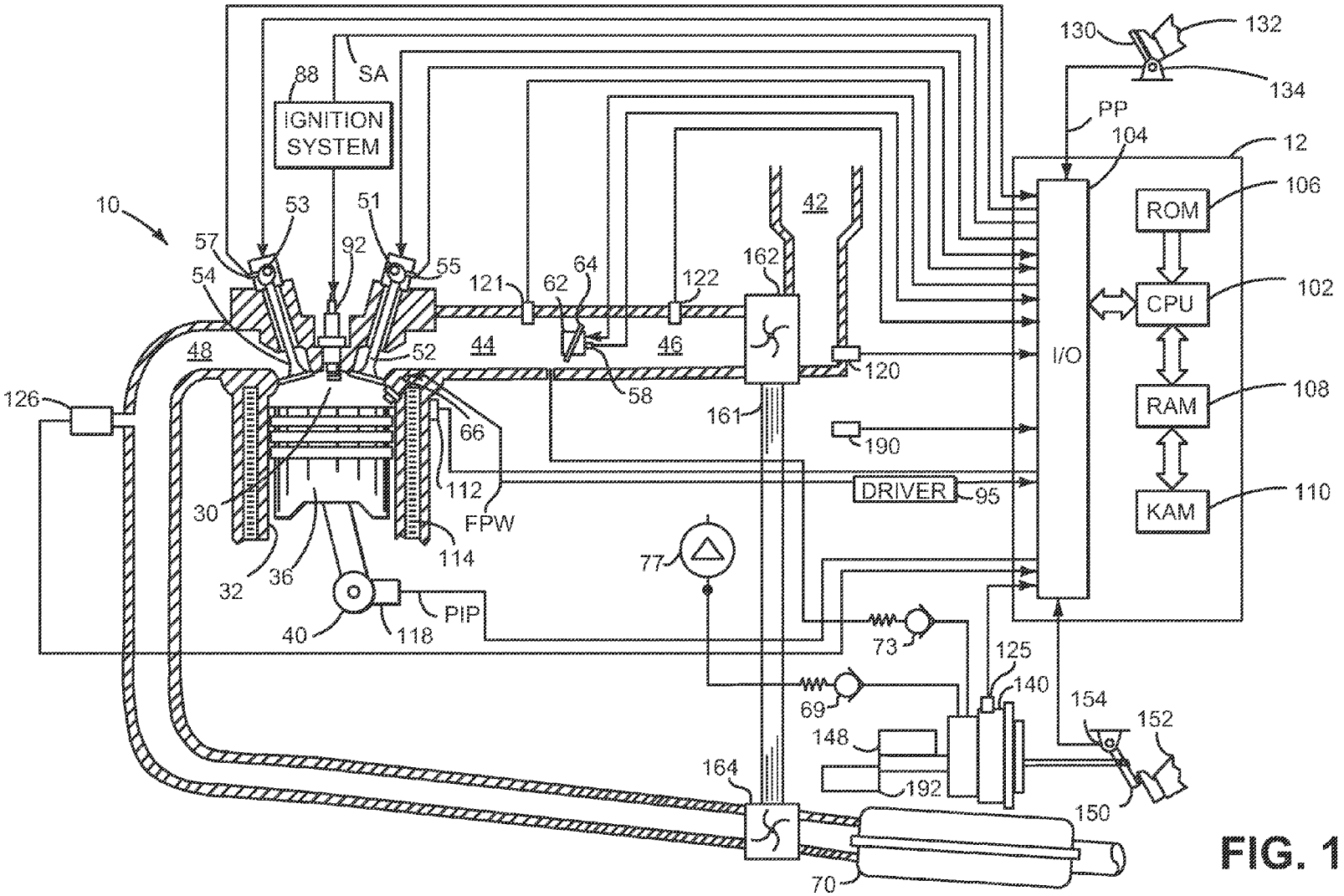
FIG. 1 shows a schematic depiction of an engine and associated vacuum system.

The present description is relates to methods and systems for adjusting an engine starting, such as in the engine system of FIG. 1. As such, engine intake manifold pressure (MAP) affects fuel evaporation and cylinder air charge. Consequently, a variation in these parameters during an engine start can cause air-to-fuel ratio errors, and thus increase exhaust emissions as the catalyst is typically not fully activated. Thus, one approach to improve air/fuel control during a start is to have a consistent manifold pressure at start. However, when trying to obtain consistent manifold pressure starts, manifold pressure and cylinder air charge variation may occur depending on the fill level of vacuum reservoirs coupled to the intake manifold, such as the vacuum reservoir of a brake booster. Even if valving between the brake booster and the intake manifold can reduce the effects of different booster fill levels at the start, some variation remains, and can lead to increased fueling errors.

Thus, one approach to provide improved manifold pressure control and consistency, as well as cylinder air charge estimating and thus engine fueling, from one start to another start, is to adjust one or more engine parameter settings, such as throttle position, cam timing, spark timing, etc., to affect MAP at crank and start. Also, accounting for flow into, or out of, the intake manifold from/to a vacuum reservoir, such as the brake booster turns what would be an air disturbance into an accounted for effect. In one embodiment, information regarding the vacuum level in the brake booster at engine start may be used to better position the various engine parameter settings, particularly during engine cranking and the engine speed run-up from crank speed to idle speed. Further, or alternatively, this information can improve estimates of fuel vaporization and cylinder air charge filling, so as to also provide better air-fuel control during engine starts and thus reduce emissions. An engine controller may be configured to perform control routines, such as the example routines of FIGS. 2-3, to adjust one or more engine parameter settings responsive to the vacuum level of a brake booster. An example throttle adjustment responsive to the brake booster vacuum is illustrated in FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown).

Fuel injector 66 is supplied operating current from driver 95 which responds to controller 12. In addition, intake manifold 44 is shown communicating with optional electronic throttle 62 which adjusts a position of throttle plate 64 to control air flow from intake boost chamber 46.

Compressor 162 draws air from air intake 42 to supply boost chamber 46. Exhaust gases spin turbine 164 which is coupled to compressor 162 via shaft 161. A waste gate actuator (not shown) may allow exhaust gases to bypass turbine 164 so that boost pressure can be controlled under varying operating conditions.

Brake booster 140, including a brake booster reservoir, may be coupled to intake manifold 44 via check valve 73. In this way, brake booster 140 is in pneumatic communication with the intake manifold solely via a single check valve. Check valve 73 allows air to flow to intake manifold 44 from brake booster 140 and limits air flow to brake booster 140 from intake manifold 44. Check valve 73 accommodates fast pull down of the reservoir pressure when reservoir pressure (e.g., of brake booster 140) is relatively high and intake manifold pressure is low. Additionally, or alternatively, vacuum pump 77 may be selectively operated via a control signal from controller 12 to supply vacuum to brake booster 140. Check valve 69 allows air to flow to vacuum pump 77 from brake booster 140 and limits air flow to brake booster 140 from vacuum pump 77. Brake booster 140 may include an internal vacuum reservoir, and it may amplify force provided by foot 152 via brake pedal 150 to master cylinder 148 for applying vehicle brakes (not shown). Specifically, master cylinder 148 is coupled to a hydraulic brake system 192 including hydraulic brake line sensor 190, which may alternatively be positioned in the master cylinder to indicate master cylinder pressure. As explained below with regard to FIG. 2, the control system may include the hydraulic master cylinder pressure sensor as an indirect, but largely proportional inference, of instantaneous brake booster volume.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands various actuators. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a position sensor 154 coupled to brake pedal 150 for sensing brake pedal position; a knock sensor for determining ignition of end gases (not shown); a measurement of engine manifold pressure (MAP) from pressure sensor 121 coupled to intake manifold 44; a measurement of boost pressure from pressure sensor 122 coupled to boost chamber 46; brake booster reservoir pressure from pressure sensor 125, an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Storage medium read-only memory 106 can be programmed with computer readable data representing instructions executable by processor 102 for performing the methods described below as well as other variants that are anticipated but not specifically listed.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Figure 2:
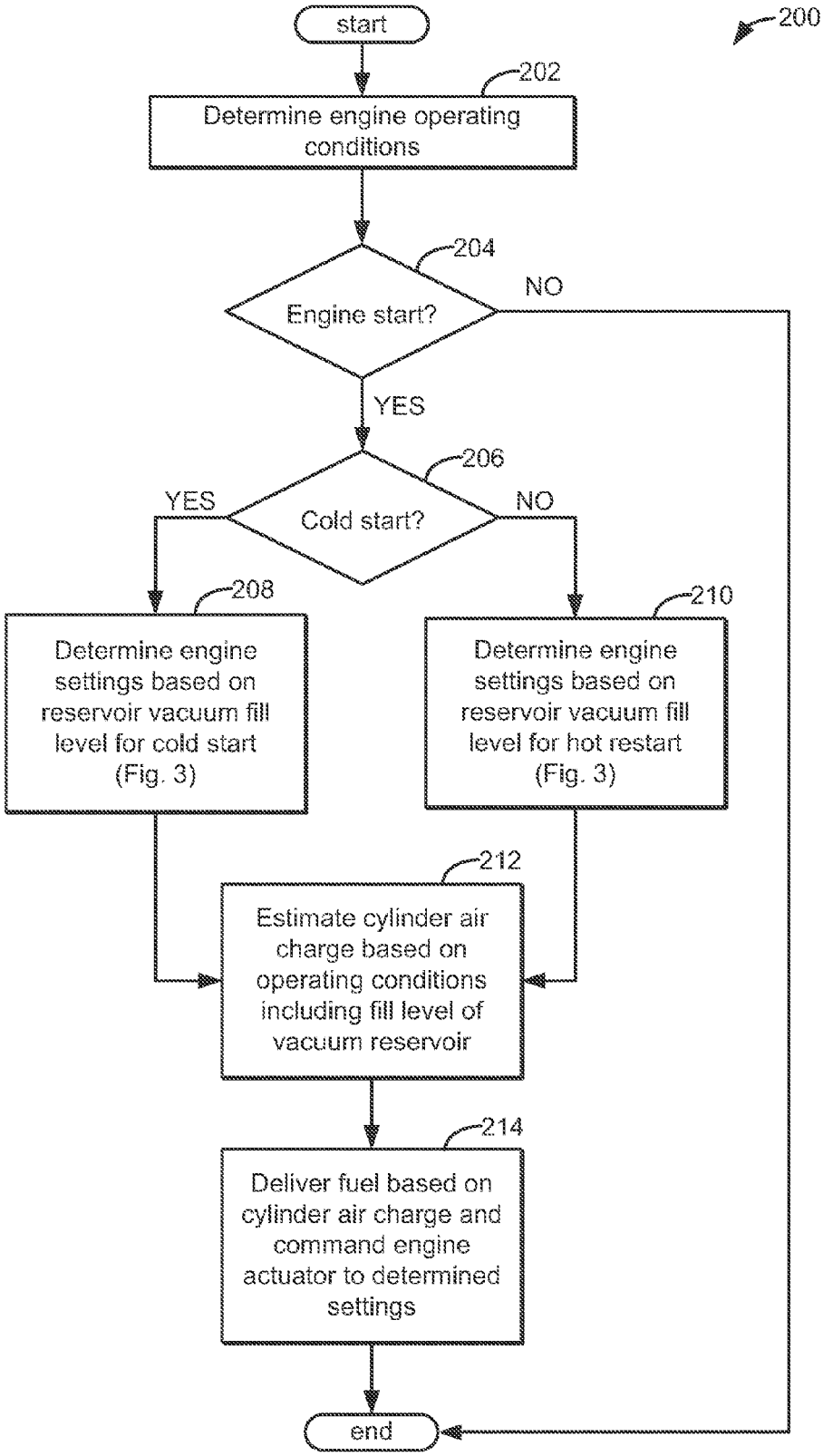
FIGS. 2-3 show high level flowcharts of a method for starting an engine by adjusting engine parameter settings based on a vacuum reservoir pressure during the start.

Now turning to FIG. 2, an example routine 200 is shown for adjusting engine settings at an engine start based on an initial pressure in a brake boost vacuum reservoir as well as based on whether the engine start is a cold start or a hot start.

At 202, engine operating conditions may be estimated and/or measured. Engine operating conditions may include but are not limited to engine speed, engine cylinder air amount, engine temperature, exhaust catalyst temperature, demanded torque, barometric pressure, ambient temperature, system vacuum levels including vacuum fill levels or pressure in various vacuum reservoirs, cylinder pressure, and throttle position. Routine 200 proceeds to 204 after engine operating conditions are determined.

At 204, an engine start condition may be confirmed. For example, it may be confirmed that the engine speed is currently below a threshold (e.g., engine is at rest), and an engine start request has been generated, such as from a key position, remote start fob, automatic engine restart, and/or others.

At 206, it may be determined whether the engine start is an engine cold start condition. In one example, an engine cold start may include engine temperature (or engine coolant temperature) being lower than a threshold temperature (such as a catalyst light-off temperature). If cold start conditions are not confirmed, then it may be determined that the engine is in a hot start condition.

If an engine cold start is confirmed, then at 208, engine settings (e.g., engine actuator settings or engine parameter settings) for an engine cold start may be determined based on vacuum reservoir vacuum fill levels (or vacuum reservoir pressure). In comparison, if an engine cold start is not confirmed, then at 210, engine settings for an engine hot start may be determined based on the vacuum reservoir vacuum fill levels (or vacuum reservoir pressure). As used herein, the vacuum reservoir pressure may include a brake booster pressure. In one example, the brake booster pressure may include a brake booster pressure level before fuel injection for the engine start commences, such as while the engine in cranking. In another example, the brake booster pressure may include a brake booster level while the engine is at rest (that is, before cranking is commenced). As elaborated in FIG. 3, the engine settings determined may include, among others, one or more of a throttle position, a cam timing, and an ignition timing.

Upon determining engine settings for the engine start (cold start or hot start) at 208 and 210, the routine proceeds to 212 to estimate a cylinder air charge based on operating conditions including the fill level of the vacuum reservoir. This may include estimating a cylinder air amount and a fuel evaporation amount during the start based on the brake booster pressure. In one example, the mass flow rate out of the brake booster can be computed from the ideal gas law. Alternatively, a model of the air into and/or out of the brake booster during the initial engine starting may be based on the vacuum fill level of the booster and the ideal gas law, where the volume is assumed to be variable, with the volume being an affine function of brake stroke, which is itself an affine function of hydraulic brake pressure. As such, from measured brake (pneumatic) pressure a volume can be estimated, and the measured brake booster vacuum may be determined from the measured pressure in the brake booster. Then, based on this information and ambient temperature, a mass (and/or a change in mass) can be determined and applied (e.g., subtracted) from to the cylinder air charge that would otherwise be provided to the cylinder (e.g., from the mass airflow sensor and manifold filling dynamics) to provide a better estimate of cylinder air charge.

At 214, the routine includes delivering fuel based on the estimated cylinder aircharge and commanding engine actuators to determined settings. Specifically, the routine adjusts and delivers a fuel injection amount that is based on the determined cylinder air amount and fuel evaporation amount.

In one example, at 208 and 210, the routine may include adjusting the throttle based on the vacuum reservoir pressure during the start, adjusting cam timing during the engine start responsive to the brake booster pressure before the start, and/or adjusting ignition timing during the engine start responsive to the brake booster pressure before the start. An engine controller may be configured to count a number of cylinder combustion events from a first combustion event (or first cylinder event) during the start. In an alternate example, the controller may count the number of cylinder events from reaching the target manifold pressure. Based on the count, the cylinder air charge estimate may be adjusted, which in turn may affect the fuel injection settings as well as the ignition timing settings. For example, an ignition timing may be adjusted for each of a plurality of combustion events counted from the first combustion event of the start based on a brake booster pressure identified before the first combustion event.

In this way, air charge estimation at engine start is computed differently based on the initial state of a brake booster pressure level. Accordingly, the air charge estimation at the engine start is compensated to increase constancy (and reduce variability) based on the initial brake booster pressure level, the compensation provided by the throttle and auxiliary air flow devices. By reducing variability in air charge estimation during engine starts, air/fuel errors during an engine start may be reduced and exhaust emissions may be improved, in particular during cold starts.

Figure 3:
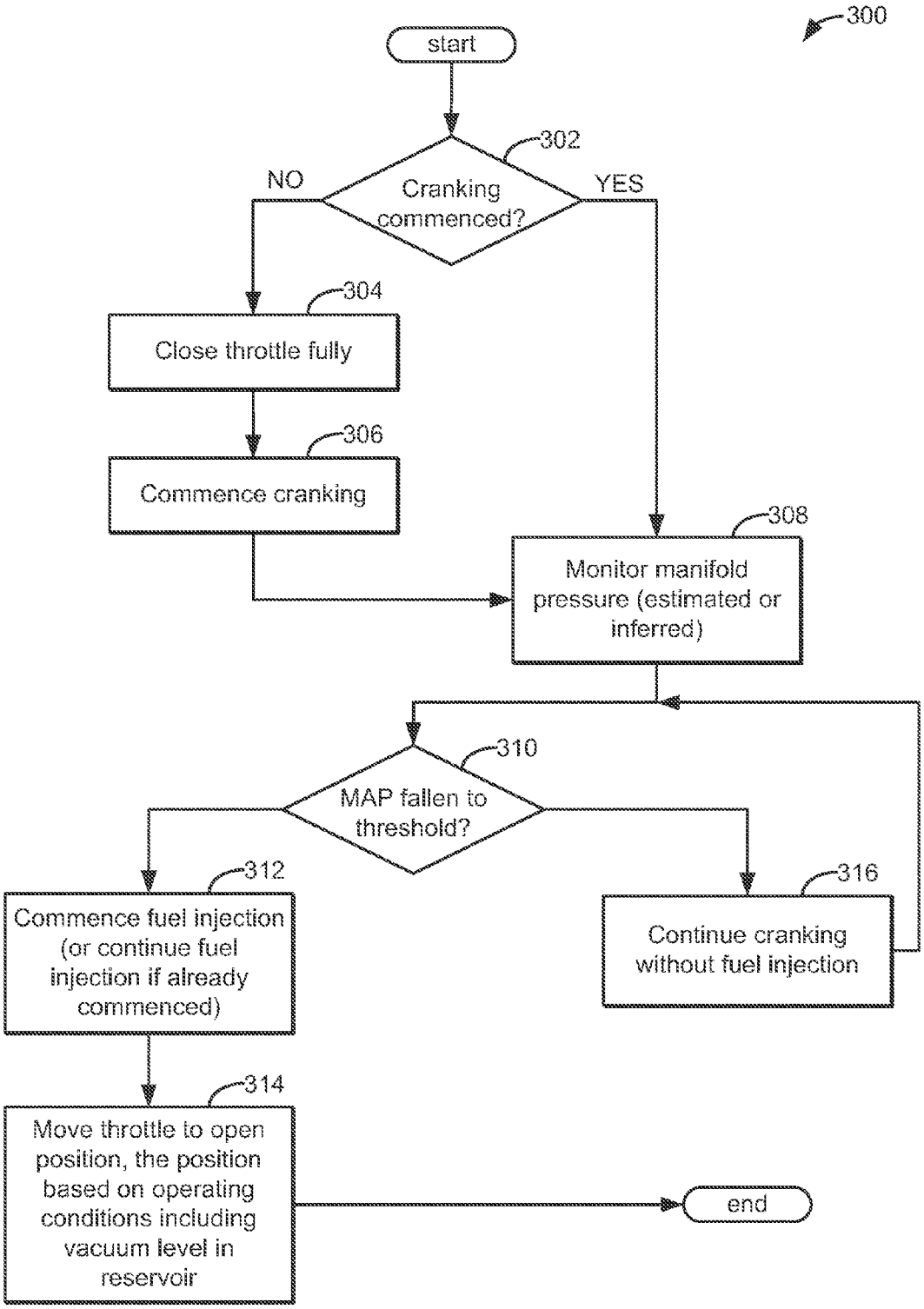
Figure 4:
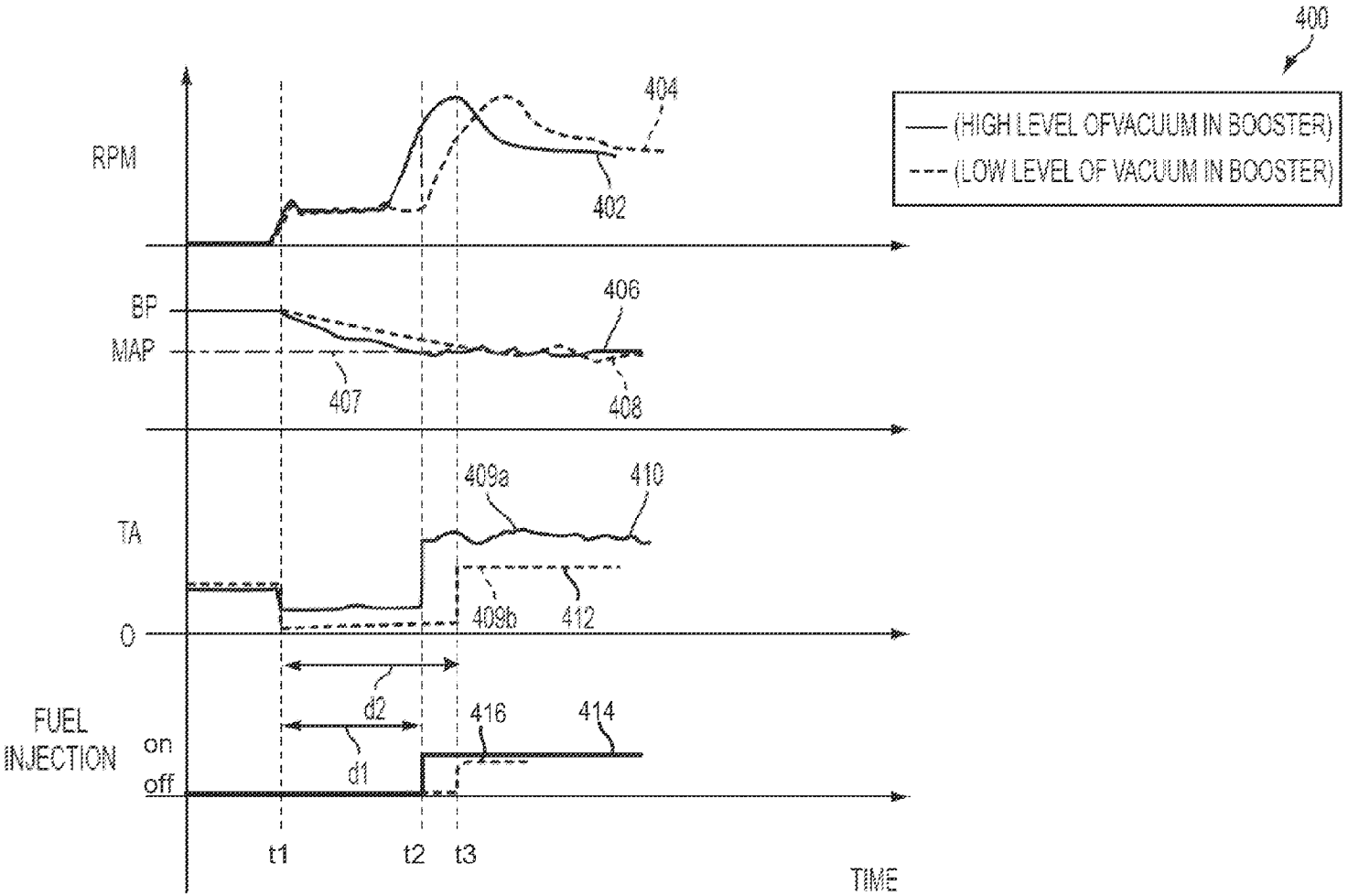
FIG. 4 shows an example throttle adjustment, according to the present disclosure.

Now turning to FIG. 3, an example routine 300 is shown for determining engine settings during an engine start based on the vacuum level of a vacuum reservoir, herein a brake booster vacuum reservoir.

At 302, it may be determined if engine cranking has commenced. In one example, based on the engine speed it may be determined if the cranking has commenced. In another example, it may be determined whether the engine is at rest and is not spinning. If cranking has not commenced (that is, the engine is at rest), then at 304, a throttle may be fully closed before cranking has commenced. At 306, cranking may be commenced. For example, an engine starter may be operated to start cranking the engine.

The closed throttle start may provide various advantages. As one example, at the engine start, it may be critical to generate as much intake vacuum as possible to power the various vacuum actuators (e.g., actuators that provide brake assist, vacuum actuated wastegates, vacuum actuated compressor bypass valves, vacuum actuated engine mounts, etc.). Herein, by closing the throttle at engine start (with IVC at maximum volumetric efficiency), the amount of intake vacuum may be maximized advantageously, where in one example, the engine is first used as a vacuum pump before it is fuelled to draw down vacuum in the intake manifold and brake booster volume. As another example, it may be desirable to achieve constant MAP engine starts. For example, consistency may be desired between an engine start at a location having a higher altitude and lower ambient temperature relative to an engine start at a location having a lower altitude and higher ambient temperature. Herein, by closing the throttle at engine start (with IVC at maximum volumetric efficiency), more consistent MAP starts may also be advantageously enabled.

If cranking has commenced at 302, or after cranking has been initiated at 306, the routine proceeds to 308 wherein a manifold pressure (MAP) is estimated and/or inferred (e.g., measured in one example via a MAP sensor). In one example, the manifold pressure may be estimated by a dedicated MAP sensor. In another example, the manifold pressure may be inferred based on the vacuum levels of the vacuum reservoir. For example, when the vacuum reservoir is a brake booster having a pressure sensor coupled thereto, the manifold pressure may be inferred based on a brake booster pressure as estimated by the brake booster pressure sensor. The manifold pressure may continue to be monitored until it reaches a target threshold pressure. The engine controller may also estimate a cranking time that is a duration of cranking required to reach the target threshold pressure.

At 310, it may be determined whether the manifold pressure has fallen to the threshold pressure. If yes, then at 312, fuel injection may be commenced. Alternatively, if fuel injection had already commenced, fuel injection may be continued. The routine then proceeds to 314 to move the throttle to an open (e.g., a more open) position, the throttle position based on operating conditions including the vacuum level in the vacuum reservoir. For example, the throttle may be positioned based on the barometric pressure and the vacuum reservoir pressure. As such, over the duration of the throttle adjustment, the cylinder air charge may also be estimated based on the initial and current brake booster pressure. The fuel injection may then be adjusted based on the estimated cylinder air charge.

In one example, the throttle is adjusted to provide substantially constant and specified MAP from one start to the next, even as barometric pressure changes. For example, lower BP may result in lower exhaust pressure, resulting in higher engine air flow rate for a given MAP. Thus, in this example, a setpoint of MAP/exhaust pressure may be used to provide increased consistency with varying barometric pressure, where the throttle is adjusted to provide the desired setpoint ratio. Additionally, the throttle flow is proportional to barometric pressure in the sonic region, but in other regions, higher barometric pressure may cause more throttle flow rate. Thus, as barometric pressure increases from one start to another, the throttle position setting may be more closed to provide the same throttle airflow rate.

In another example, the throttle may be positioned more closed for higher absolute brake booster pressure levels. In another example, the throttle may be positioned more closed for higher initial absolute pressures in the reservoir before the start (e.g., before cranking has commenced) and then positioned more open for lower initial absolute pressures in the reservoir before the start. In still another example, the throttle may be temporarily (e.g., for a duration) held fully closed during the start immediately before positioning the throttle to at least a partially open position, a degree of the opening of the throttle based on the brake booster pressure.

Returning to 310, if manifold pressure has not fallen to the threshold amount, then at 316, the engine may continue to be cranked without any fuel injection. Only after the threshold manifold pressure is attained, the routine may proceed to commence fuel injection.

In this way, when the brake booster is at a higher pressure (that is a lower vacuum level), a more closed cranking and start throttle position is enabled (that is, a cranking with the throttle more closed and an engine start with the throttle at the more closed position) while when the brake booster is at a lower pressure (that is a higher vacuum level), a less closed (or more open) cranking and start throttle position is enabled (that is, a cranking with the throttle more open and an engine start with the throttle at the more open position). As such, when the brake booster is at the higher pressure (or lower vacuum level), the cranking time required to attain the target MAP is likely to be longer than when the brake booster is at the lower pressure (or higher vacuum level). Further cranking time consistency, if desired (e.g., to attain minimum cranking time in both conditions), may be attained by additional cranking in the higher brake booster pressure condition.

The throttle position may be additionally adjusted based on whether the engine start is a hot start or a cold start. For example, the throttle may be positioned more closed during a hot start while the throttle may be positioned more open during a cold start, and further the throttle may be adjusted based on the vacuum level of the brake booster.

It will be appreciated that while the routines of FIGS. 2-3 elaborate actuator adjustments in response to a brake booster pressure, in alternate embodiments, the actuator may be adjusted in response to the vacuum level of an alternate vacuum reservoir such as a vacuum reservoir coupled to one or more additional vacuum consumers (e.g., vacuum actuators). Likewise, while the routines of FIGS. 2-3, and the examples of FIG. 4 elaborate throttle position adjustments responsive to a vacuum reservoir vacuum level, in alternate embodiments, other actuators may be additionally or optionally adjusted such as an ignition timing, a cam timing and fuel injection timing The concepts introduced in the routines of FIGS. 2-3 are now clarified, in FIG. 4 wherein map 400 describes example throttle position adjustments responsive to vacuum levels in a brake booster. Specifically, map 400 depicts changes in engine speed at graphs 402 and 404, changes in manifold pressure at graphs 406 and 408, changes in throttle position at graphs 410 and 412, and changes to fuel injection at graphs 414 and 416. As such, graphs 402, 406, 410, and 414 (solid lines) depict the changes for a first start from rest with a brake booster relatively full (that is, under conditions of a higher vacuum level in the brake booster) while graphs 404, 408, 412, and 416 (dashed lines) depict corresponding changes for a second start from rest with the brake booster relatively empty (that is, under conditions of a lower vacuum level in the brake booster).

Before t1, the engine may be at rest (graphs 402 and 404) with the throttle at a default throttle position that is more open (graphs 410 and 412), the intake manifold pressure (MAP) at barometric pressure (BP) (graphs 406 and 408), and with no fuel being injected into the engine (graphs 414 and 416). At t1, an engine start may be determined.

For the first start from rest (as depicted at graphs 402, 406, 410, and 414, in solid lines), the brake booster may be relatively full and have a higher level of vacuum. Accordingly, at t1, the throttle may be closed while the engine is cranked using a starter motor. Specifically, the throttle may be closed by a smaller amount (that is, less closed) as compared to a start with a relatively empty brake booster. The throttle may remain closed during cranking until the manifold pressure drops from BP to a target threshold amount 407. As such, when the brake booster is relatively full, the duration of closed throttle cranking (d1) required to reach the threshold amount of MAP may be smaller. Accordingly, at t2, once manifold pressure reaches the threshold amount 407, the throttle may be opened. Specifically, the throttle may be opened by a first amount to bring the throttle a relatively more open position 409*a*. Additionally, at t2, fuel injection may be returned to the spinning engine and the engine speed may increase. Further still, a target MAP may also be adjusted based on fuel volatility, with a lower MAP setting for cold or less volatile fuels at cold start as compared to more volatile fuels. As such, the MAP setting and throttle setting may further be adjusted based on fuel quality.

In comparison, for the second start from rest (as depicted at graphs 404, 408, 412, and 416, in dashed lines), the brake booster may be relatively empty and have a lower level of vacuum. Accordingly, at t1, the throttle may be closed while the engine is cranked using a starter motor. Specifically, the throttle may be closed by a larger amount (that is, more closed) as compared to the start with the relatively full brake booster. The throttle may remain closed during cranking until the manifold pressure drops from BP to the target threshold amount 407. As such, when the brake booster is relatively empty, the duration of closed throttle cranking (d2) required to reach the threshold amount of MAP may be larger. That is, the cranking duration is longer for the second start as compared to the first start. Accordingly, at t3 (after t2), once manifold pressure reaches the threshold amount 407, the throttle may be opened. Specifically, the throttle may be opened by a second, greater amount to bring the throttle to a more open position 409*b*. As such, the open throttle position 409*a* during the first start may be a more open position than the open throttle position 409*b* during the second start, however, the change in throttle position from the closed position during cranking to the open position following cranking may be greater during the second start as compared to the first start. Additionally, at t3, fuel injection may be returned to the spinning engine and the engine speed may increase. As such, the second amount of throttle opening during the second engine start may be larger than the first amount of throttle opening during the first engine start.

Thus, during both the first and second starts, the throttle may first be closed (e.g., fully closed) before being opened. In both cases, a closed throttle cranking may be performed until the manifold pressure drops to the same threshold amount (to enable consistent MAP starts). Since the brake booster is in pneumatic communication with the intake manifold of the engine solely via a single check valve, the duration of closed throttle cranking increases as the amount of vacuum in the brake booster at the start decreases. Fuel injection is then commenced upon opening the throttle in both the first and second starts.

As such, for each of the first and second starts, an air charge may be determined based on an initial fill level of the brake booster. Fuel injection may then be delivered based on the determined air charge, with the determined air charge being greater for the second start as compared to the first start.

In this way, to allow engine starts to occur at a consistent MAP, during the first start, when the brake booster is relatively full, the engine may be cranked with the throttle less closed for a shorter duration before fueling the engine, while during the second start, when the brake booster is relatively empty, the engine may be cranked with the throttle more closed for a longer duration before fueling the engine.

Thus, the routines presented herein provide for an engine method comprising estimating a cylinder air charge of cylinder events based on a first fill level of a brake booster and brake booster volume, the volume based on hydraulic brake pressure. The method includes wherein the cylinder air charge is estimated for a start from rest with the brake booster at the first fill level, and wherein the cylinder event includes a first combustion event from rest of the engine during a start.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for starting an engine, comprising:

positioning a throttle based on a brake booster pressure; and estimating a cylinder air amount and fuel evaporation amount during a start based on the brake booster pressure.

2. The method of claim 1 wherein the brake booster pressure includes a brake booster pressure level while the engine is at rest, and wherein the throttle is further positioned based on barometric pressure.

3. The method of claim 1 wherein the brake booster pressure includes a brake booster pressure level before fuel injection for the start commences.

4. The method of claim 3 wherein the throttle is positioned more closed for higher absolute brake booster pressure levels.

5. The method of claim 4 wherein the brake booster is in pneumatic communication with an intake manifold solely via a single check valve.

6. The method of claim 1 wherein the throttle is positioned more closed for higher initial pressures in the brake booster before the start, and is positioned more open for lower initial pressures in the brake booster before the start.

7. The method of claim 1 further comprising adjusting cam timing during the engine start responsive to the brake booster pressure before the start.

8. The method of claim 1 further comprising temporarily holding the throttle fully closed during the start before positioning the throttle to at least partially open, a degree of the opening based on the brake booster pressure.

9. The method of claim 1 further comprising adjusting an ignition timing for each of a plurality of combustion events counted from the first combustion event of the start, the ignition timing adjusted based on the brake booster pressure identified before the first combustion event.

10. The method of claim 1 further comprising adjusting a fuel injection amount based on the cylinder air amount and the fuel evaporation amount.

* * * * *